US007980174B2

(12) United States Patent
Alt-Steiner et al.

(10) Patent No.: US 7,980,174 B2
(45) Date of Patent: Jul. 19, 2011

(54) PAGE OF A PRINTED PRODUCT HAVING A PLURALITY OF INFORMATION FIELDS ARRANGED IN DIFFERENT PRINT COLUMNS, AND LONGITUDINAL PERFORATION DEVICE FOR PRODUCING THE PAGE

(75) Inventors: Adrian Helmut Alt-Steiner, Würzburg (DE); Matthias Faller, Dettelbach (DE); Thorsten Winfried Haag, Oberpleichfeld (DE); Bernhard Anton Harant, Helmstadt (DE); Burkard Otto Herbert, Würzburg (DE); Andreas Kunzemann, Güntersleben (DE)

(73) Assignees: Koenig & Bauer Aktiengesellschaft, Wurzburg (DE); Mediengruppe Main-Post GmbH, Wurzburg (DE)

( * ) Notice: Subject to any disclaimer, the term of this patent is extended or adjusted under 35 U.S.C. 154(b) by 561 days.

(21) Appl. No.: 12/081,384

(22) Filed: Apr. 15, 2008

(65) Prior Publication Data

US 2008/0258453 A1 Oct. 23, 2008

(30) Foreign Application Priority Data

Apr. 23, 2007 (DE) ..... 20 2007 005 909 U
Apr. 25, 2007 (DE) ..... 10 2007 019 864

(51) Int. Cl.
*B41F 13/56* (2006.01)

(52) U.S. Cl. ..... 101/224; 101/226

(58) Field of Classification Search ..... 101/224, 101/226

See application file for complete search history.

(56) References Cited

U.S. PATENT DOCUMENTS

| | | | | | |
|---|---|---|---|---|---|
| 3,540,340 | A | * | 11/1970 | Koskela | 83/499 |
| 3,886,833 | A | * | 6/1975 | Gunn et al. | 83/499 |
| 3,930,700 | A | | 1/1976 | Figueres | |
| 4,294,637 | A | * | 10/1981 | Rump | 156/157 |
| 4,506,577 | A | * | 3/1985 | Shinomiya et al. | 83/499 |
| 4,570,518 | A | * | 2/1986 | Burmeister et al. | 83/504 |
| 4,592,259 | A | * | 6/1986 | Gorner et al. | 83/13 |
| 4,685,699 | A | | 8/1987 | Hirasawa | |

(Continued)

FOREIGN PATENT DOCUMENTS

CA 2181752 9/1999

(Continued)

*Primary Examiner* — Daniel J Colilla
*Assistant Examiner* — David Banh
(74) *Attorney, Agent, or Firm* — Jones, Tullar & Cooper, P.C.

(57) ABSTRACT

A page of a printed product having a plurality of information fields arranged in different printed columns is provided. At least one perforated line, extending parallel to the height of the page, is generated in the page between at least two printed columns. The at least one perforated line is formed over the entire height of the page. At least one printed column, along with its at least one information field, can be completely separated from the remaining part of the page via a separation process to be performed along a single such perforated line. The perforated line to be used to execute the separation process extends through a pictogram that is situated along both sides of this perforated line. The pictogram visualizes the position of this perforated line. A longitudinal perforation device for a web-fed rotary printing press can be used to produce this page and has at least one perforating blade for generating the perforated line. The longitudinal perforation device is configured as an autonomous module. That module can be used in different places in the same web-fed rotary printing press or at different times in different web-fed rotary printing presses.

30 Claims, 3 Drawing Sheets

U.S. PATENT DOCUMENTS

| | | | | | |
|---|---|---|---|---|---|
| 4,701,063 | A | * | 10/1987 | Wysk et al. | 400/621 |
| 4,784,030 | A | * | 11/1988 | Waring | 83/105 |
| 4,793,251 | A | * | 12/1988 | Kuhfuss | 101/93.01 |
| 4,835,720 | A | * | 5/1989 | Ditto et al. | 702/158 |
| 4,909,148 | A | * | 3/1990 | George | 101/178 |
| 4,979,838 | A | * | 12/1990 | Yokota et al. | 400/621 |
| 5,042,788 | A | * | 8/1991 | Bowman et al. | 270/21.1 |
| 5,066,153 | A | * | 11/1991 | Stephens | 400/621 |
| 5,560,291 | A | * | 10/1996 | Shu | 101/41 |
| 5,761,980 | A | * | 6/1998 | Ima et al. | 83/500 |
| 5,790,168 | A | * | 8/1998 | Sano et al. | 347/262 |
| 5,857,395 | A | * | 1/1999 | Bohm et al. | 83/408 |
| 6,435,092 | B1 | | 8/2002 | Hillebrand | |
| 6,520,701 | B2 | * | 2/2003 | Kaya | 400/621 |
| 6,553,881 | B2 | * | 4/2003 | Marmin | 83/407 |
| 6,821,038 | B2 | * | 11/2004 | Izawa | 400/621.1 |
| 6,949,062 | B2 | * | 9/2005 | Theilacker | 493/475 |
| 7,424,852 | B2 | * | 9/2008 | Dempster et al. | 101/226 |
| 2003/0024424 | A1 | * | 2/2003 | Pasman et al. | 101/226 |
| 2004/0159251 | A1 | * | 8/2004 | Theilacker | 101/226 |
| 2004/0159693 | A1 | * | 8/2004 | Adachi et al. | 225/3 |
| 2005/0268802 | A1 | * | 12/2005 | Evans et al. | 101/226 |
| 2007/0194169 | A1 | | 8/2007 | Herbert et al. | |

FOREIGN PATENT DOCUMENTS

| | | | |
|---|---|---|---|
| DE | 1 190 957 | | 4/1965 |
| DE | 41 37 897 | C1 | 12/1992 |
| DE | 196 25 787 | A1 | 3/1997 |
| EP | 1 346 937 | A2 | 9/2003 |
| WO | WO 99/30909 | | 6/1999 |
| WO | WO 2004/056686 | A1 | 6/1999 |

* cited by examiner

PAGE OF A PRINTED PRODUCT HAVING A PLURALITY OF INFORMATION FIELDS ARRANGED IN DIFFERENT PRINT COLUMNS, AND LONGITUDINAL PERFORATION DEVICE FOR PRODUCING THE PAGE

CROSS-REFERENCE TO RELATED APPLICATIONS

This U.S. patent application claims priority under 35 USC, Section 119 to DE 20 2007 005 909, filed Apr. 23, 2007 and to DE 10 2007 019 864, filed Apr. 25, 2007. The disclosures of these documents are expressly incorporated by reference.

FIELD OF THE INVENTION

The present invention is directed to a page of a printed product having a plurality of information fields positioned in different print columns arranged side by side and separated by a perforated line, and to a longitudinal perforation device suitable for producing this page having such a perforated line.

BACKGROUND OF THE INVENTION

A device for use in the processing and/or conveying of a web in a web-fed rotary printing press is known from WO 2004/056686 A1. This device has at least one web processing tool which is configured as a fold former, and one web processing tool that is configured as a cutting blade and which is situated upstream from the fold former in the web path. The cutting blade and the fold former can be moved crosswise to the direction of travel of the material web via at least one actuator. The cutting blade is configured as the cutting blade of a longitudinal cutting device, which is situated upstream from the fold former, and is provided with a lateral drive that is mechanically separate from a drive of the fold former. The longitudinal cutting device has at least two cutting blades that are spaced apart from one another crosswise to the direction of web travel. These at least two cutting blades can be moved crosswise to the web travel direction, but each in a direction that is opposite from the other via a shared drive. The drive for the fold former and the drive of the cutting blade are in functional active connection with one another through a shared control device. The functional active connection is preferably structured such that the two drives can be regulated in a shared work process, especially during an adjustment process, by way of a program sequence. The control device is preferably configured to determine a suitable target position for the respective cutting blade from data on the web width and/or a planned web path, and to the respective drive to arrive at this suitable target position.

A method for producing a newspaper is known from WO 99/30909 A1. In a web-fed rotary printing press, a plurality of material webs or of partial material webs are guided one over another. Prior to the accomplishment of a crosswise cutting of a partial web of material, perforations are formed in the partial material web. At least one part of the now perforated partial web, that is connected, in terms of content, to the rest of the partial web, such as, for example, a block of information, is delimited by these perforations. Additionally, at least one column of the partial web is delimited by perforations that extend continuously over the entire height of a page.

U.S. Pat. No. 4,685,699 A describes a sheet, which is provided with perforations and that is intended for insertion in a newspaper. The sheet is intended to be provided with removable coupons.

A publication with removable cards is known from U.S. Pat. No. 3,930,700 A. The cards may be separated by the use of perforations.

Frequently, a perforated line, which has been generated in a page of a printed product, is difficult for a reader to detect due to its fine cross-section. This makes it difficult to separate the perforated portion of the page from the rest of the page, along the perforated line because of the reader's difficulty in detection of the line of perforation.

SUMMARY OF THE INVENTION

The object of the present invention is to create a page of a printed product having a plurality of information fields which are arranged in different printed columns. In accordance with the present invention, a position of a perforated line generated in the page can be easily detected by a person who is viewing the page. Additionally, in accordance with the present invention, a longitudinal perforation device is provided, which longitudinal perforation device is suitable for producing this printed product with the perforated page. The location of the longitudinal perforation device, in the web-fed rotary printing press, can be easily exchanged.

The objects of the present invention are attained, according to the present invention, with the provision of a pictogram on the printed page and which extends on both sides of the perforated line. The pictogram makes the line of perforation much more visible. The longitudinal perforation device is configured as a module that is independent of the web-fed rotary printing press. Such a module can be used in different places in the same web-fed rotary printing press or can be used at different times in different web-fed rotary printing presses.

The benefits to be achieved with the present invention consist especially in that by using the proposed longitudinal perforation device, a printed product can be produced. At least one page of such a printed product, in which a perforated line that would otherwise by difficult to detect, is visualized. To aid in such visualization of the perforated line, the pictogram, which has -been applied to the page, also encourages the viewer to actually perform a separation process along such a perforated line. The pictogram can be implemented along the perforated line. It is particularly advantageous, in accordance with the present invention, for the pictogram to depict a motif that is associated with an information field in the printed column, which is to be separated along the perforated line. With this cooperation of pictogram and information field, a particular promotional function can be assigned to the pictogram, in combination with the information field to be separated. The pictogram thereby increases, for example, the promotional function which is intended to be accomplished by an information field, thus giving the pictogram a multipurpose function. A pictogram, as used in this context, is an image with a motif that is visually similar to a tangible object, so that the viewer will associate concrete informational content with the pictogram. The new advertising form which is described here can contribute to producing the desired interactivity between advertiser and newspaper reader without requiring, for example, the placement of post-it notes, and without spending the additional time and expense that such a manual operation requires in the shipping department. The present invention thus increases the rate of response to current notices by commercial or other clients.

The longitudinal perforation device, in accordance with the present invention, which may be used in producing this printed product, has the advantage of being configured as an autonomous module, which, by virtue of its simple installation and the resultant associated short set-up time, can be flexibly used in one, or even in multiple web-fed rotary printing presses. Advantageously, a position of a perforating blade, which is utilized in this longitudinal perforation device, and which is adjusted transversely to a direction of travel of the web of printing substrate, can be altered, without risk, by a person who is operating the web-fed rotary printing press and while the web-fed rotary printing press is in operation. In a further embodiment of the present invention, the position of the perforating blade can also be automatically reset in order to maintain a predetermined, fixed correlation of the perforating blade and thus of the resultant line of perforation to the relevant printed image. With the longitudinal perforation device, in accordance with the present invention, for example, a newspaper can be produced, which has at least one newspaper page with a section that can be separated cleanly along the height of that newspaper page without the need for, or the use of auxiliary devices. The perforated line that can be produced using the longitudinal perforation device always extends over the entire height of the newspaper page. However, it can be variably positioned across the width of such a newspaper page.

BRIEF DESCRIPTION OF THE DRAWINGS

A preferred embodiment of the present invention is depicted in the set of drawings, and will be described in greater detail in what follows.

The drawings show in.

DESCRIPTION OF THE PREFERRED EMBODIMENT

Figure 1:
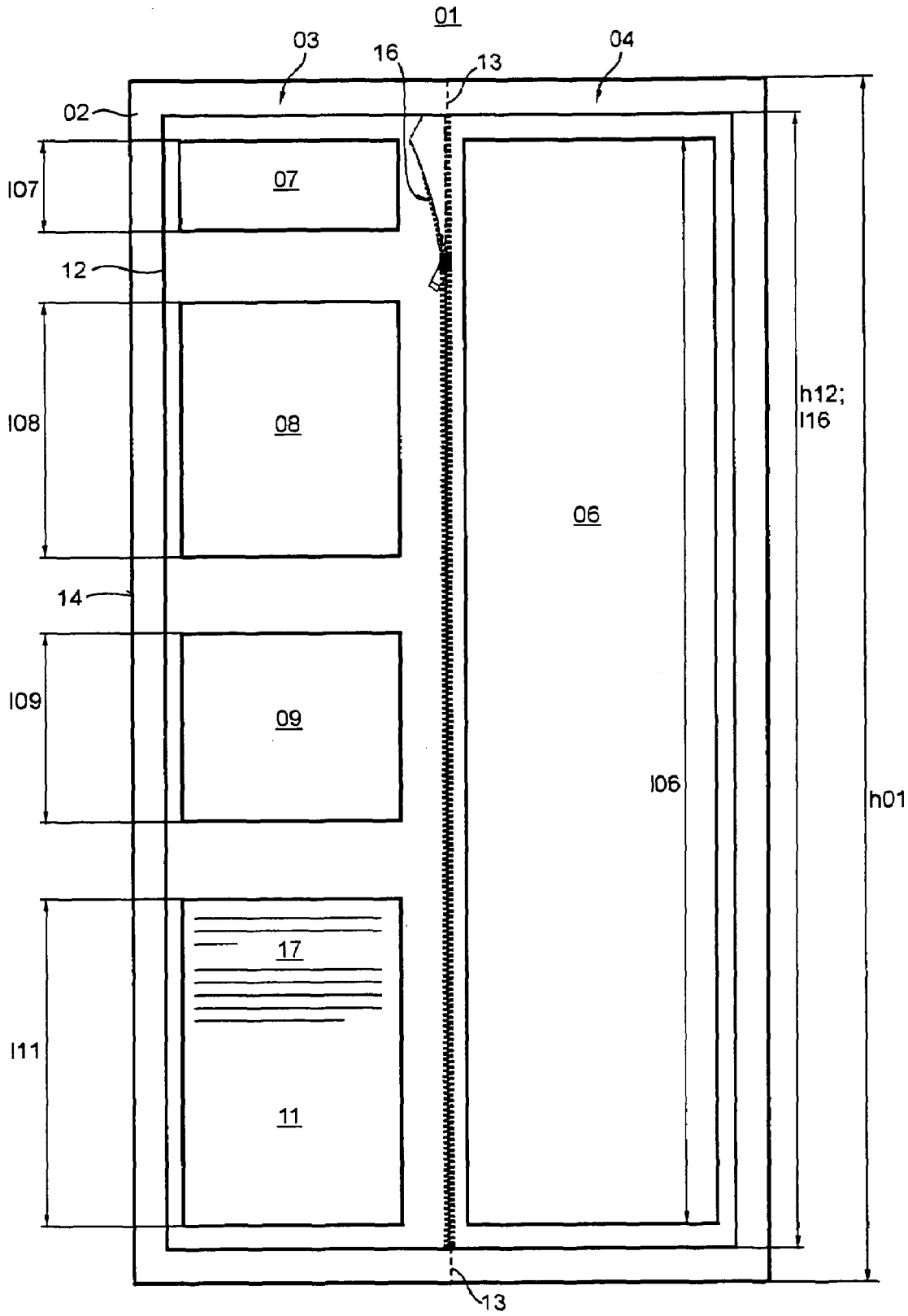
FIG. 1 a schematic depiction of a page of a printed product with a perforated line in accordance with the present invention.

Referring initially to FIG. 1, there may be seen a preferably rectangular page 01 of a printed product, that has been printed with a plurality of information fields 06; 07; 08; 09; 11 that are all arranged on the same side or surface 02 of the page 01, and that are situated in different printed columns 03; 04, wherein the page 01 has two linear dimensions that are orthogonal to one another. In the depicted example shown in FIG. 1, one of the two sides or surfaces of the page 01, such as, for example, the front side 02 is shown. The front side 02 of page 01 has at least two columns 03; 04 in its type area 12, which type area 12 is preferably printed or at least is printable by a printing press, and particularly by a rotary printing press. The type area 12 can also easily have more than the depicted two columns 03; 04 shown in FIG. 1. A representation of more than two columns 03; 04 has been dispensed with in the depiction of FIG. 1 for purposes of simplicity and clarity. The page 01 can be a part of a newspaper or a part of a newspaper-like printed product. The page 01 is therefore preferably configured as a newspaper page, which page can be situated either vertically or horizontally, based upon its orientation in the printed product. Each information field 06; 07; 08; 09; 11 typically contains information that is related, in terms of content, and which can consist, for example, of a text and/or a pictorial representation such as, for example, as a reproduction of a photo.

Between the two printed columns 03; 04, which are arranged side-by-side on the same side 02 of the page 01, as seen in FIG. 1, a perforated line 13, that extends parallel to the height h01 of the page 01, is generated in the page 01. The perforated line 13 is continuous along the entire height h01 of the page 01. The height h01 of a page 01, as used in this context, is the linear measurement of the page 01 which extends orthogonally to the orientation of the overwhelming majority of the lines of text 17 which are contained in the information fields 06; 07; 08; 09; 11. In the depicted information field 11, a plurality of text lines 17 are shown schematically, by way of example, to illustrate their orientation. In the embodiment of page 01 shown in FIG. 1, the height h01 of the page 01 corresponds to its longer edge 14. This may not always be the case, depending on the orientation of the majority of the lines of text 17. If the type area 12 of page 01 has more than two columns 03; 04, more than the one perforated line 13, which is shown in FIG. 1, can also be provided, with each of these perforated lines 13 extending continuously along the entire height h01 of the page 01. The type area 12 has a type area height h12 that extends parallel to the height h01 of the page 01. The perforated line 13 is a cutting line that is equipped with openings, with each cut segment dividing the page 01 completely. Cut segments and their openings in the same perforated line 13 can have different lengths.

At least one printed column 03; 04, together with its at least one information field 06; 07; 08; 09; 11, can be easily completely separated from the remaining part of the page 01, along a single perforated line 13, in a separation process to be performed without auxiliary devices. In the example which is shown schematically in FIG. 1, the right printed column 04 can be cleanly separated from the remaining part of the page 01, leaving the left printed column 03, without damaging the page 01 as is apt to occur if such a separation is attempted in an uncontrolled manner. The perforated line 13, which is intended to be used to perform the separation process, extends through a pictogram 16 that extends on both sides of the perforated line 13, as seen in FIG. 1. The pictogram 16 visualizes the location of this perforated line 13, so that the pictogram 16 makes it clear to the viewer where on the page 01 the perforated line 13, to be used in the separation of the page 01, is located. In the example shown in FIG. 1, the pictogram 16 has a motif that depicts a zipper or that is, at least, similar to a zipper. The two sides of the pictogram zipper represented by the motif, each of which sides is depicted as being equipped with cramps, or small teeth, are arranged along the two sides of, and extending along the perforated line 13. The attached zipper pull is arranged precisely on the perforated line 13, thereby giving the viewer the visual impression or indication that this zipper should be used to separate one part of the page 01 from the other part. This impression can be intensified by depicting the zipper in a partially opened state, as it is shown in FIG. 1. This pictogram 16 representing a zipper is especially advantageous if it is related, in some way, to an information field 06; 07; 08; 09; 11 in the printed column 03; 04 that is to be separated along the perforated line 13, such as, for example, in which products from the clothing industry are being advertised. The advantageous effect of intensifying the function of the advertisement is enhanced in that at least one of the information fields 06; 07; 08; 09; 11 to be separated and the motif of the pictogram 16 are linked with one another in terms of content. The viewer is encouraged, in this way, to associate concepts that are related to one another at least by type. The pictogram 16 is preferably applied to the side or face 02 of the page 01 using the same printing technique as is used to print the images in the other information fields 06; 07; 08; 09; 11, and preferably using the same printing process as is used in the application of the information fields 06; 07; 08; 09; 11 on the same side 02 of the relevant page 01.

The pictogram 16, that extends on both sides of the perforated line 13, also extends over at least a section of the perforated line 13 that is to be used for the separation process. In accordance with the present invention, it can also be provided that a pictogram 16 is situated along the perforated line 13 in each of a plurality of sections of the perforated line 13, and with a plurality of individual pictograms 16, preferably each with the same motif, being arranged along the perforated line 13. In an alternative embodiment, a plurality of individual pictograms 16, with different individual motifs, can also be arranged along the same perforated line 13. Regardless of whether one or more pictograms 16 are arranged along the same perforated line 13, a length 116 of the respective pictogram 16, which, in any case extends along a section of the perforated line 13, extends over at least 20% of the height h12 of the type area 12, and preferably extends over at least 50% of the height h12 of the type area 12. The length 116 of the pictogram 16 that extends along a section of the perforated line 13 is preferably formed over at least 70% of the height h12 of the type area 12. Pictogram 16 can also extend over the entire height h12 of the type area 12, as is shown in the example depicted in FIG. 1. If the pictogram 16 is applied to the side or face 02 of the page 01 using printing techniques, its length 116 is generally limited by the height h12 of the type area 12 that is also applied to side or face 02 of page 01.

The information fields 06; 07; 08; 09; 11, which are typically arranged in printed columns 03; 04, and which are intended to be separated from one another, each have a section length 106; 07; 108; 09; 11 1, which is oriented parallel to the perforated line 13 to be used for accomplishment of the separation process. It is preferable that the length 116 of the pictogram 16 that extends along a section of the perforated line 13 corresponds at least to the section length 106; 07; 108; 09; 111 of one of the information fields 06; 07; 08; 09; 11 that are arranged in the printed columns 03;, 04 to be separated from one another. In the example shown in FIG. 1, in this case, the smallest measure of the length 116 of the pictogram 16 is the section length 107 of the information field 07 which is situated uppermost in the left column 03.

Figure 2:
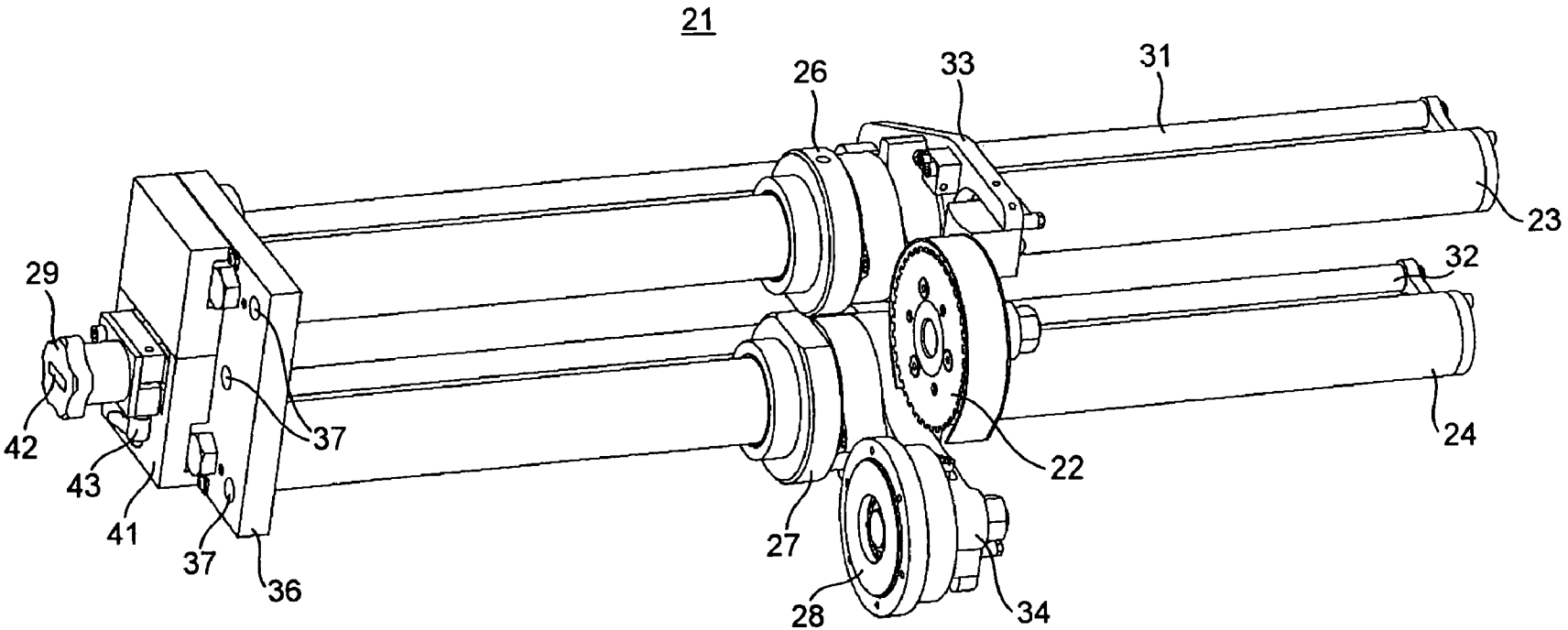
in FIG. 2 a perspective view of a longitudinal perforation device in accordance with the present invention and suitable for use in generating the perforated line in the page of printed product, as depicted in FIG. 1.

The printed product is preferably produced using a web-type printing substrate, such as, for example, a material web, and especially a paper web. The printed product can have a plurality of pages 01, which can, for example, also be attached to one another, such as, for example, via a form closure or an adhesive closure. The perforated line 13 to be used for the above-described separation process is generated in the page 01, such as, for example, by using either a perforating blade 22, which is situated in the superstructure of a printing press, as depicted in FIG. 2, or by the use of a perforating blade 22 which is allocated to a folding apparatus, in a configuration that is not specifically shown. The perforated line 13 is preferably a longitudinal perforation of the material web, typically a perforation extending in the web's direction of transport. The perforating blade 22 can engage in a plurality of layers of the printing substrate, which layers are arranged one on top of another, at the same time, if a perforated line 13 is to be generated in each one of the stacked material webs.

The page 01 is preferably printed on both sides or faces, such as, for example, on its front and its reverse sides or faces 02. The configuration of the printed columns 03; 04 printed on the front side and on the reverse side 02 is preferably coordinated such that the perforated line 13 extends, on both the front side and the reverse side 02 of the page 01 between two printed columns 03; 04, each containing at least one information field 06; 07; 08; 09; 11. The position of the perforated line 13 is then preferably visualized on both the front side 02 and also on the reverse side 02 of the page 01, in each case, by at least one pictogram 16, and preferably is visualized on both sides 02 by the same pictogram 16. The printed columns 03; 04, which are situated on the front side and reverse side 02 of page 1 and which are to be separated along the same perforated line 13, preferably each have at least one information field 06; 07; 08; 09; 11, with these fields being related to one another in terms of content. For example, they can contain advertisements from the same firm. A large format advertisement can also be situated on the front side 02 of page 01, for example, with a coupon or a contact address for the firm advertising on the front side 02 being arranged on the reverse side 02 of page 01.

Figure 3:
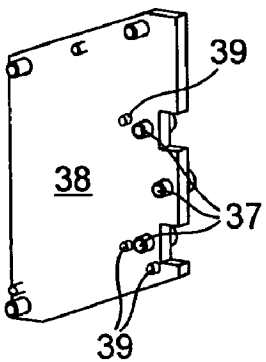
in FIG. 3 a perspective view of a mounting device which is usable for installing the longitudinal perforation device of FIG. 2 in a printing press; and in FIG. 4 a schematic depiction of a pneumatic diagram for use in controlling pivoting levers of the longitudinal perforation device in accordance with FIG. 2.

A longitudinal perforation device 21 for use with a printing press, such as, for example, a web-fed rotary printing press, and having at least one perforating blade 22, will now be described, with reference to FIG. 2 through FIG. 4. Through the utilization of this longitudinal perforation device 21, the above-described printed product, comprising at least one page 01, and with a perforated line 13 that extends continuously along the height of this page 01, can be produced. The at least one perforating blade 22 of the longitudinal perforation device 21 can be adjusted crosswise to the direction of travel of a web of printing substrate to any position along the width of the web of printing substrate, and can also be set to a specific position. The perforating blade 22 now generates the perforated line 13 in the web of printing substrate, with perforated line 13 extending in the direction of travel of the web. The perforating blade 22 preferably generates a very fine cut of very narrow width, which cut nevertheless passes through the entire thickness of the web of printing substrate. The thickness of the web of printing substrate ranges, for example, from a few tenths of a millimeter downwardly. The perforated line 13 is not typically located on, and extends outside of the transverse center of the web of printing substrate. To produce a page 01, in which a generated perforated line 13 passes through a printed image 16, and especially through a pictogram 16, which pictogram 16 extends on both sides of this perforated line 13, and wherein the pictogram 16 visualizes the position of said perforated line 13, it is provided that the position of the perforating blade 22, which is set crosswise to the direction of travel of the web of printing substrate, is in fixed correlation with the position of the pictogram 16 applied to the web of printing substrate. The perforated line 13, that is generated in the web of printing substrate by the perforating blade 22, passes through the pictogram 16.

As is illustrated in the perspective representation depicted in FIG. 2, the longitudinal perforation device 21 has two guide elements 23; 24 which are situated parallel to one another, and each of which is structured, for example, as a hollow shaft 23; 24 for the purpose of minimizing its weight. The at least one layer of printing substrate web to be perforated can be arranged to pass between these two guide elements 23; 24. When these two guide elements 23; 24 are installed in the web-fed rotary printing press, they are arranged with their respective lengths situated orthogonal to the direction of travel of the web of printing substrate, which web is not depicted in FIG. 2.

Each of the two guide elements 23; 24 has a support 26; 27, which can be adjusted in an axial direction of the respective guide element 23; 24, preferably by shifting it along its respective guide element. One of the supports 26 supports the perforating blade 22, which is rotatably mounted in a bearing assembly, as a so-called fly blade 22. The other support 27 supports a cutting ring 28, also mounted in a rotatable bearing, and adapted to function as a bed blade 28. The perforating blade 22 and the cutting ring 28 are positioned-on their respective guide elements 23; 24 in such a way that they interact with each other to form a perforated line 13 to be generated in the web of printing substrate in its direction of travel. The perforating blade 22 and the cutting ring 28 are thus engaged against one another to form the perforated line 13 which, as depicted in FIG. 1, extends in the direction of travel of the web of printing substrate that forms the rectangular pages 01.

Each of the supports 26; 27, which are non-rotatably guided for axial movement on the respective guide elements 23; 24, such as, for example, by being in engagement with a groove formed in the guide, is coupled with an actuating drive 31; 32. Each of the two actuating drives 31; 32 for the respective supports 26; 27 is configured, for example, as a threaded spindle 31; 32 which is arranged parallel to the longitudinal axis of its respective guide element 23; 24. Each support 26; 27 is adjusted, in terms of its respective axial position, by a rotational movement of the allocated threaded spindle 31; 32 and is thus caused to shift axially along the respective guide element 23; 24. The adjustment of each support 26; 27 is implemented using an adjustment device 41, which is an integral part of the longitudinal perforation device 21 and which preferably is capable of positioning both supports 26; 27 in the same adjustment process. This adjustment device 41 can be actuated manually, such as, for example, by use of a hand wheel 29, or can be actuated automatically. For instance, the adjustment device 41 can also be remotely controlled, especially from a control center, which is not specifically depicted, and that is a part of the web-fed rotary printing press. The hand wheel 29 is preferably located outside of the area of the longitudinal perforation device 21 that guides the web of printing substrate. Accordingly, so that a person operating the web-fed rotary printing press can actuate this hand wheel 29 without risk, even if the web-fed rotary printing press is in operation. The axial position of at least the perforating blade 22 can be reset when a production operation is underway, even by way of a manual adjustment.

Each support 26; 27 preferably includes a pivotable lever 33; 34, respectively, to which lever 33, 34 the perforating blade 22 or the cutting ring 28, respectively, is attached. As may be seen in FIG. 2, each pivotable lever 33; 34 is attached, at its respective inboard end to its associated one of the supports 26; 27 and carries its perforating blade 32 or cutting ring 28 at its respective outboard end. The perforating blade 22 and the cutting ring 28, are typically not rotationally motor-actuated, and instead rotate only as a result of their contact with the web of printing substrate, as it is being moved in its direction of travel. The pivoting levers 33; 34 are each capable of pivoting around a point of rotation, which point of rotation preferably coincides with the center of the respective guide element 23; 24, via actuation of, for example, a pneumatic drive 44; 46, such as, for example, a working cylinder 44; 46, as is seen in FIG. 4. With the, for example, remotely controlled actuation of the respective pneumatic drive 44; 46 and the respective pivoting movement of the pivotable levers 33; 34 thereby initiated, the perforating blade 22 and the cutting ring 28 can be selectively engaged against the web of printing substrate to generate the perforated line 13, or can be retracted from the web of printing substrate. The engagement and/or the disengagement of the perforating blade 22 and of the cutting ring 28 on the web of printing substrate preferably occur synchronously. Alternatively, the cutting ring 28 can be engaged against one side of the web of printing substrate first, after which, the perforating blade 22 can be engaged against the other side of the web of printing substrate.

The two spaced, parallel guide elements 23; 24, preferably along with their respective, connected actuating drives 31; 32, are attached to a shared base plate 36 on at least one of their respective end surfaces, as is depicted in FIG. 2. The two spaced, parallel guide elements 23; 24 are attached, each at one of their axial ends, to this base plate 36, which base plate 36 is different from a frame of the web-fed rotary printing press, preferably in a cantilevered configuration. The two spaced, parallel guide elements 23; 24 are thus cantilevered, in a yoke-like fashion, from the shared base plate 36. The longitudinal perforation device 21 is thus preferably configured as a module having only a single base plate 36 to which all of the essential elements of the longitudinal perforation device 21 are attached. This includes the guide elements 23; 24 for the pivoting levers 33; 34 that support the perforating blade 22 or the cutting ring 28, respectively, each such guide element being configured as a cantilevered arm that is supported at only one, inboard end. This structure of the longitudinal perforation device results in a component that can be easily retrofitted to various printing presses and which can be flexibly used with such various printing presses.

The longitudinal perforation device 21 can, if desired or if necessary, such as for reasons of web width, be attached, in the direction of travel of the web of printing substrate, at both sides of the web-fed rotary printing press, and if necessary can even be mounted overhead above the path of web travel through the rotary printing press.

The base plate 36 for the longitudinal perforation device, which preferably also supports the adjustment device 41 for use in the positioning of the respective supports 26; 27, along with each support's respective one of the perforating blade 22 or the cutting ring 28, can preferably be mounted on the web-fed rotary printing press, separably and/or only temporarily, using a small number of connecting elements 37. As depicted in FIG. 3, three such connecting elements 37 can be provided on a stationary mounting device 38 which is included in the web-fed rotary printing press. The mounting device 38 is permanently attached to, for example, the frame of the web-fed rotary printing press which is not specifically depicted in FIG. 3. To mount the base plate 36 of the longitudinal perforation device 21 on the mounting device 38, screws 37 or a suitable quick-release coupling can be provided as the connecting elements 37. In addition to the connecting elements 37, alignment elements, such as, for example, alignment pins 39 can be provided on the mounting device 38 to accomplish the precise orientation of the longitudinal perforation device 21 on the mounting device 38. The longitudinal perforation device 21 thus forms a module that is preferably autonomous of, or separable from the web-fed rotary printing press and which can therefore be flexibly used, as needed, in the web-fed rotary printing press. Set-up times, which may be required for placing the longitudinal perforation device 21 in operation, are advantageously minimized. The same module can optionally be positioned for use at different locations in the web-fed rotary printing press, anywhere a corresponding mounting device 38 is provided. The exchange and relocation of a module can be performed within a very short time using only a small number of connecting elements 37. It is not necessary to keep a plurality of longitudinal perforation devices 21 on hand, thereby resulting in substantial cost savings. In a print shop that operates multiple web-fed rotary printing presses, the same longitudinal perforation device 21 can also be exchanged among the respective web-fed rotary printing presses as needed. Anytime the special printed product with the page 01 having the continuous perforated line 13 is to be produced on one of the web-fed rotary printing presses, the longitudinal perforation device 21, by virtue of its configuration as an autonomous module, can be used at different times with different web-fed rotary printing presses.

The longitudinal perforation device 21 is preferably situated in a respective web-fed rotary printing press in the direction of travel of a web of printing substrate, preferably upstream from a fold former of the web-fed rotary printing press. The fold former can be adjusted, for example, in its position crosswise to the direction of travel of the web of printing substrate. The at least one perforating blade 22 of the longitudinal perforation device 21 can be adjusted, in respect to its position crosswise to the direction of travel of the web of printing substrate, independently of at least the position of the fold former, which fold former can also be shifted crosswise to the direction of travel of the web of printing substrate. In addition, the adjustment device 41, which is usable to adjust the position of the at least one perforating blade 22 crosswise with respect to the direction of travel of the web of printing substrate, is separate at least from an adjustment device used to adjust the fold former crosswise to the direction of travel of the web of printing substrate. A web of printing substrate which has passed through the longitudinal perforation device: 21 and which is thus provided with the perforated line 13, then passes over the fold former, which is not specifically shown.

The adjustment device 41 preferably has a display device 42, such as, for example, a scale 42 that indicates a dimensional property, through the use of which, a position of the perforating blade 22 can be clearly quantified or verified. The center of the fold former, for example, can serve as a reference for the dimensional property displayed on the scale 42. The position of the at least one perforating blade 22 can thus be adjusted, relative to the center of the fold former. A dimensional property displayed on the scale 42 can then be interpreted as a distance measurement which is oriented crosswise to the direction of travel of the web of printing substrate, relative to the center of the fold former. Another variation provides that an edge 14 of the web of printing substrate being guided between the guide elements 23; 24, as seen in FIG. 1, is used as a reference. This edge 14 is oriented along the direction of travel of the web of printing substrate. Once the web of printing substrate fed into the web-fed rotary printing press has passed between the guide elements 23; 24, the scale 42 is preferably moved to zero as soon as the perforating blade 22 reaches this web edge 14. A dimensional property, which can be displayed on the scale 42, then indicates a measure of the distance from this edge 14, namely the distance of the position of the perforating blade 22, adjusted after calibration of the adjustment device 41, from this edge 14. The adjustment device 41 is in an actuatable operating position, once an immobilizing device or stop 43, which preferably acts on both supports 26; 27, has been released. The immobilizing device or stop 43 fixes the axial position of at least the perforating blade 22, once the perforating blade 22 has been positioned along one of the guide elements 23; 24 by operation of the adjustment device 41. The immobilizing device 43 can be released or locked, such as, for example, mechanically by using a clamping lever.

The position of the perforating blade 22 is advantageously determined using data, which data has preferably been electronically stored in a computer unit, and which data was generated on a prepress that is to precede the printing process to be performed using the web-fed rotary printing press. This data determines the position of the print image to be imprinted on the printing substrate, and, from the use of a fixed correlation between the print image and the perforated line 13 that must be maintained, determines the position or orientation of the perforated line 13. Using this data, the distance measurement, such as, for example, of the edge 14 of the web of printing substrate from the position of the perforating blade 22, which is adjusted using the adjustment device 41, is adjusted. The adjustment device 41 performs the adjustment of the distance measurement automatically, such as, for example, through program control.

Figure 4:
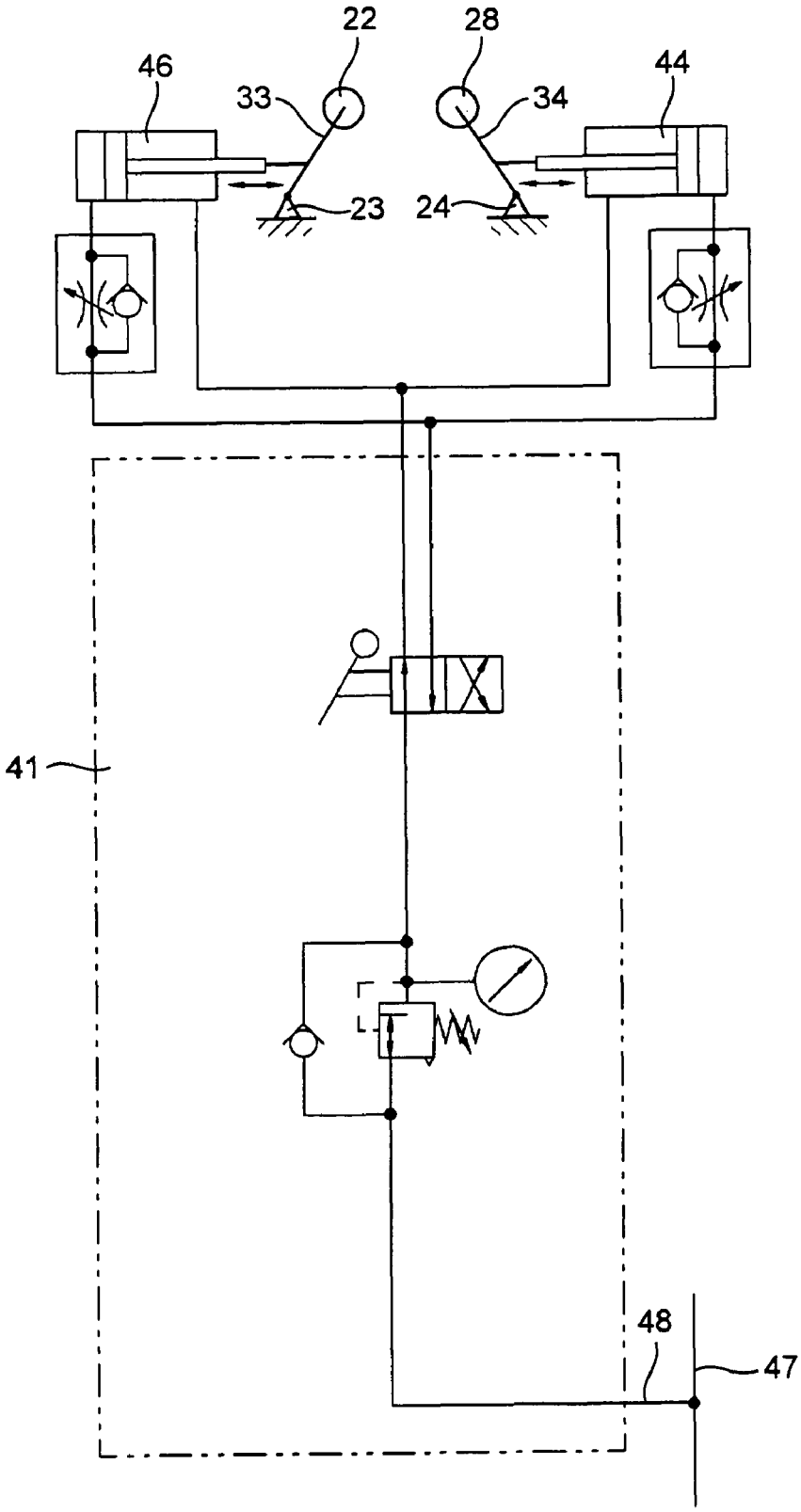

FIG. 4 provides a pneumatic flow diagram illustrating an example of the actuation of the pivoting levers 33; 34, each by a pneumatic drive 44; 46, such as, for example, a working cylinder 44; 46. Each pivoting lever 33; 34 can preferably pivot around a point of rotation that coincides with the center of the respective guide element 23; 24. One of the pivoting levers 33 supports the perforating blade 22, while the other pivoting lever 34 supports the associated cutting ring 28. The pneumatic drives 44; 46 are preferably connected to a shared pneumatic source 47. Control elements, such as, for example, valves, for controlling the pneumatic drives 44; 46 are typically arranged in the adjustment device 41 which is used to adjust the position of the perforating blade 22. Therefore, the adjustment device 41 has only a single pneumatic connection line 48, which favorably affects the set-up time for the longitudinal perforation device 21, which is especially configured as an autonomous module.

While preferred embodiments of a page of a printed product having a plurality of information fields arranged in different print columns, and a longitudinal perforation device for providing the page, in accordance with the present invention, have been set forth fully and completely hereinabove, it will be apparent to one of skill in the art that various changes in, for example, the type of printing press used, the drives for the printing cylinders and the like could be made without departing from the true spirit and scope of the present invention which is accordingly to be limited only by the appended claims.

What is claimed is:

1. A longitudinal web perforation device usable in a web-fed rotary printing press having spaced side frames, said longitudinal web perforation device comprising:

at least one perforating blade usable to generate a perforated line in a web of printing substrate, said perforated line extending along a direction of travel of said web of printing substrate through said web-fed rotary printing press and through said web perforation device;

an elongated perforating blade guide element supporting said at least one perforating blade above a first side of said web of printing substrate and for movement transversely to said direction of travel of said web of printing substrate, said elongated perforating blade guide element having spaced first and second ends;

a cutting ring cooperating with said at least one perforating blade to form said perforated line in said web of printing substrate as said web passes between said perforating blade and said cutting ring;

an elongated cutting ring guide element spaced from, and parallel to, said elongated perforating blade guide element and supporting said cutting ring below a second side of said web of printing substrate and for movement transversely to said direction of travel of said web, said elongated cutting ring guide element having spaced first and second ends;

an adjustment device usable to cooperatively move each of said at least one perforating blade and said cutting ring transversely to said direction of travel of said web of printed substrate along, their respective ones of said perforating blade guide element and said cutting ring guide element to any position across a width of said web of printing substrate; and a shared base plate separate from said web-fed rotes printing press and separably securable to a slide frame of said web-fed rotary printing press, said first end of said elongated perforating blade guide element, said first end of said elongated cutting ring guide element and said adjustment device each being attached to said shared base plate, said elongated perforating blade guide element and said elongated cutting blade guide element each extending from said shared base plate as a cantilevered arm and being spaced from each other, said elongated perforating blade guide element, said elongated cutting ring guide element, said adjustment device, and said shared base plate cooperating to configure said longitudinal perforation device as a module which is insertable transversely to said direction of travel of said web and through a side frame of said web-fed rotary printing press with said second ends of said elongated perforating blade guide element and said elongated cutting blade guide element being unsupported and allowing passage of said web of printing substrate therebetween during said insertion of said module transversely to said direction of travel of said web and through said side frame of said web-fed rotary printing press, said module being usable in a plurality of locations in one or more of said web-fed rotary printing-presses.

2. The longitudinal web perforation device of claim 1 further including a printed image applied to said web of printing substrate by said web-fed rotary printing press, said position of said preforating blade being adjustable, transversely to said direction of web travel along said elongated perforating blade guide element whereby said perforation tine generated by said perforating blade in said web of printing substrate passes through said printed image.

3. The longitudinal web perforation device of claim 1 wherein said perforation tine is located outside of a center of said web of printing substrate.

4. The longitudinal web perforation device of claim 1 wherein said perforating blade is pivotably mounted on said elongated perforating blade guide element.

5. The longitudinal web perforation device of claim 1 wherein each of said perforating blade and said cutting ring are supported by pivotable levers on their respective ones of said elongated guide elements.

6. The longitudinal web perforation device of claim 5 further including a support for each of said perforating blade and said cutting ring and their associated pivotable levers, each said support being movable along its respective one of said elongated guide elements.

7. The longitudinal web perforation device of claim 6 further including an actuating drive for said support for each of said perforating blade and said cutting ring.

8. The longitudinal web perforation device of claim 7 wherein each said actuating drive is a threaded spindle arranged parallel to a respective one of said elongated guide elements.

9. The longitudinal web perforation device of claim 8 wherein rotational movement of each said threaded spindle adjusts axial portion of each said respective support along its one of said guide elements.

10. The longitudinal, web perforation device of claim 5 further including a drive to pivot each of said pivotable levers about its respective one of said elongated guide elements.

11. The longitudinal web perforation device of claim 10 further including a said pivotable lever drive.

12. The longitudinal web perforation device of claim 11 wherein said control synchronously pivots both of said first and second pivotable levers.

13. The longitudinal web perforation device of claim 11 wherein said control pivots said first and second pivotable levers serially.

14. The longitudinal web perforation device of claim 11, wherein said control for each said pivotable lever drive located in said adjustment device.

15. The longitudinal web perforation device of claim 10 wherein each said pivotable level drive is a pneumatic drive.

16. The longitudinal web perforation device of claim 5 wherein said pivotable levers are each usable to move a respective one of said perforating blade and said cutting ring between an engaged position and a disengaged position with said web of printing substrate.

17. The longitudinal web perforation device of claim 1 further including a hand wheel usable to actuate said adjustment device.

18. The longitudinal web perforation device of claim 1 wherein said adjustment device is remotely actuable.

19. The longitudinal web perforation device of claim 1 further including an adjustment device immobilizer usable to fix an axial position of said at least one perforating blade.

20. The longitudinal web perforation device of claim 1 further including an adjustment device display usable to quantify a position of said at least one perforating blade.

21. The longitudinal web perforation device of claim 20 wherein said web-fed rotary printing press includes a fold former and wherein said adjustment device display is usable to position said at least one perforating blade relative to a center of said fold former.

22. The longitudinal web perforation device of claim 20 wherein an edge of said web of printing substrate is a reference for a dimensional properly displayed on said adjustment device display, said dimensional property being a measurement of a distance of said at least one perforating blade from said edge of said web of printing substrate.

23. The longitudinal web perforation device of claim 1 further including a mounting device secured to said side frame and adapted to receive, said shaded base plate to attach said module to said web-fed rotary printing press.

24. The longitudinal web perforation device of claim 23 further including not more than three connecting elements usable to connect said module to said mounting device.

25. The longitudinal web perforation device of claim 23 further including alignment devices on said mounting device and said shared base plate of said module.

26. The longitudinal web perforation device of claim 1 further including a fold former in said web-fed rotary printing press, said at feast one perforating blade being positioned before, in said direction of travel of said web of printing substrate, said fold former.

27. The longitudinal web perforation device of claim 1 wherein said web of printing substrate is printed with columns on first and second sides, with each said column containing at least one information field and further wherein said at least one perforating blade generates said perforated line on said web of printing substrate printed with said columns.

28. The longitudinal web perforation device of claim 27 wherein said perforated line extends between first and second spaced ones of said printed columns on said first and second sides of said web of printable substrate.

29. The longitudinal web perforation device of claim 1 wherein a said perforated line generated on said web of printing substrate using said at least one perforating blade is visualized on first and second sides of said web as at least one pictogram.

30. The longitudinal web perforation device of claim 29 wherein said perforated line is visualized on both said first and second sides of said web using one pictogram.

* * * * *

UNITED STATES PATENT AND TRADEMARK OFFICE

CERTIFICATE OF CORRECTION

PATENT NO. : 7,980,174 B2
APPLICATION NO. : 12/081384
DATED : July 19, 2011
INVENTOR(S) : Alt-Steomer et al.

It is certified that error appears in the above-identified patent and that said Letters Patent is hereby corrected as shown below:

Column 11, claim 3, line 45, after “perforation”, change “tine” to --line--.

Column 12, claim 9, line 3, after “adjusts”, insert --an--.

Column 12, claim 11, line 9, after “a”, insert --means remotely controlling--.

Column 12, claim 14, line 18, after “drive”, insert --is--.

Column 12, claim 15, line 21, after “pivotable”, change “level” to --lever--.

Column 12, claim 23, line 51, after “said”, change “shaded” to --shared--.

Column 12, claim 25, line 57, after “including”, insert --cooperating--.

Column 12, claim 26, line 61, after “at”, change “feast” to --least--.

Column 13, claim 29, line 8, after “wherein”, delete “a”.

Signed and Sealed this
Twenty-second Day of November, 2011

David J. Kappos

David J. Kappos
*Director of the United States Patent and Trademark Office*